US007568934B1

(12) United States Patent
Williams et al.

(10) Patent No.: US 7,568,934 B1
(45) Date of Patent: Aug. 4, 2009

(54) ELECTRICAL CONNECTOR HAVING A SEALING MECHANISM

(75) Inventors: Brian James Williams, York, PA (US); David Compton Heck, Camp Hill, PA (US); Thomas Allen Brungard, York, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/104,551

(22) Filed: Apr. 17, 2008

(51) Int. Cl.
*H01R 13/52* (2006.01)

(52) U.S. Cl. ..... 439/271

(58) Field of Classification Search ..... 439/578–585, 439/287, 180, 352, 253, 256, 271–273, 277–278
See application file for complete search history.

(56) References Cited

U.S. PATENT DOCUMENTS

| | | | | |
|---|---|---|---|---|
| 3,430,184 | A | 2/1969 | Acord | |
| 3,452,316 | A * | 6/1969 | Mocek et al. | 439/255 |
| 4,941,846 | A * | 7/1990 | Guimond et al. | 439/578 |
| 5,167,522 | A | 12/1992 | Behning | |
| 5,595,499 | A * | 1/1997 | Zander et al. | 439/352 |
| 6,267,612 | B1 | 7/2001 | Arcykiewicz et al. | |
| 6,361,348 | B1 | 3/2002 | Hall et al. | |
| 6,619,876 | B2 | 9/2003 | Vaitkus et al. | |
| 6,692,285 | B2 | 2/2004 | Islam | |
| 6,749,454 | B2 | 6/2004 | Schmidt et al. | |
| 6,769,926 | B1 | 8/2004 | Montena | |
| 6,848,931 | B2 | 2/2005 | McMullen et al. | |
| 6,884,105 | B2 | 4/2005 | Turck et al. | |
| 7,229,303 | B2 | 6/2007 | Vermoesen et al. | |
| 7,238,047 | B2 | 7/2007 | Saettele et al. | |

FOREIGN PATENT DOCUMENTS

| | | | |
|---|---|---|---|
| DE | 10121675 | A1 | 11/2001 |
| DE | 10235675 | A1 | 5/2003 |
| DE | 102006012194 | A1 | 9/2007 |
| EP | 01686660 | A2 | 8/2006 |
| WO | WO-2007/062845 | A1 | 6/2007 |

OTHER PUBLICATIONS

"Snap-Lock SMA Series"; Tyco Electronics; Copyright 2007; 4 Pgs.
"M12 quick-connect technology"; TURCK Industrial Automation; Copyright 2007; 1 Pg.

* cited by examiner

*Primary Examiner*—Edwin A. Leon

(57) ABSTRACT

An electrical connector configured to engage a header is provided. The connector includes a plug that is configured to be inserted into a header cavity and a sleeve member that surrounds an outer plug surface. The sleeve member includes a plurality of fingers biased to flex away from the plug surface in a flared arrangement. The connector also includes a sealing band that grips the plug surface. Also, the connector includes a collar that is configured to slide in the axial direction. When the collar moves from the retracted position to the locked position, the collar deflects the fingers against the wall surface of the header causing the fingers to cover the sealing band and the sealing band is compressed between the plug body and the header.

20 Claims, 7 Drawing Sheets

ELECTRICAL CONNECTOR HAVING A SEALING MECHANISM

BACKGROUND OF THE INVENTION

The invention relates generally to electrical connectors, and more particularly to electrical connectors that form an environmental seal around an electrical or fiber optic connection.

Push-pull electrical connectors may provide a quick method for establishing a communicative and/or power connection between systems and devices. Generally, push-pull type connectors only move along an axial direction and are not required to be twisted or rotated. In some known electrical connectors, the connectors include a plug and a header configured to receive and engage the plug in order to establish the connection. One common method of engaging the plug and header is for the plug to engage and rotate about external threads on the header surface. However, push-pull type connectors are generally not constructed to be twisted or rotated. Thus, the push-pull connectors must be adapted in order to engage the external threads. One concern in adapting or reconfiguring the push-pull connector is that the electrical connection may be vulnerable to damage or otherwise negatively affected by the surrounding environment.

One known push-pull type connector that is configured to engage external threads uses a spring basket and a movable sleeve having a cavity configured to hold the spring basket therein. The spring basket is configured to engage the external threads of a header and includes a plurality of tines that are biased to extend in an axial direction parallel to the header surface. The tines are separated from each other and include internal threads on the inner surface and external ridges that protrude radially outward from the outer surface. When the connector initially engages the header, the sleeve continues to slide over the spring basket until the sleeve engages the ridges of the tines. The tines are then deflected or compressed into the external threads of the header. The sleeve then continues to move forward over the tines. Once a front end of the sleeve has moved over the ridges, the tines move within the cavity and are allowed to move into the original, uncompressed position away from the external threads. As such, the tines are not utilized in forming an environmental seal.

Thus, there is a need for a push-pull electrical connector that forms an environmental seal. Furthermore, there is a need for a push-pull connector that may grip and form an environmental seal around headers having external threads.

BRIEF DESCRIPTION OF THE INVENTION

In one embodiment, an electrical connector configured to sealably engage a header for establishing one of an electrical and an optical connection is provided. The header includes an outer wall surface and a front edge that defines an opening to a cavity that extends therethrough in an axial direction. The connector includes a plug that is configured to be inserted into the cavity for establishing the connection. The plug includes an outer plug surface. The connector also includes a sleeve member that surrounds the plug surface. The sleeve member includes a plurality of fingers biased to flex away from the plug surface in a flared arrangement. The connector also includes a sealing band that grips the plug surface. Also, the connector includes a collar that is configured to slide in the axial direction over the sleeve member and between a retracted position and a locked position. When the collar moves from the retracted position to the locked position, the collar deflects the fingers against the wall surface of the header causing the fingers to cover the sealing band and the sealing band is compressed between the plug body and the front edge.

Optionally, the plug may include a shoulder that extends radially outward from the plug surface. When the collar is in the locked position the sealing band may be compressed by the shoulder and a front edge. Furthermore, the plug may optionally include a sealing groove that extends around the plug surface proximate to the shoulder. The sealing band may grip the plug within the sealing groove. Also, the header may include a front edge that defines an opening to the cavity. When the collar is in the locked position the sealing band may be compressed between the shoulder, the front edge, and the fingers. Optionally, when the collar is in the locked position, the fingers of the sleeve member may form a cylindrical body that substantially surrounds a portion of the wall surface.

In another embodiment, an electrical connector that is configured to sealably engage a header for establishing one of an electrical and an optical connection is provided. The header defines a cavity that extends therethrough in an axial direction and includes a wall surface having external threads. The connector includes a plug that is configured to be inserted into the cavity for establishing the connection. The plug includes a plug surface. Also, the connector includes a sleeve member that grips the plug surface. The sleeve member includes a base portion and a plurality of fingers extending from the base portion. The fingers are biased to flex away from the plug body in a flared arrangement. The fingers have a substantially smooth outer surface and include inner thread elements that are configured to engage a portion of the external threads. The connector also includes a collar that is configured to slide in the axial direction over the sleeve member and between a retracted position and a locked position. When the collar moves from the retracted position to the locked position the collar deflects the fingers toward and against the outer surface of the header causing the inner thread elements of each finger to sealably engage a portion of the external threads.

Optionally, the plug may be formed from a plug body and an intermediate housing having a channel for receiving the plug body. The intermediate housing may include a retaining member and a shoulder that extend radially outward from the plug surface. The collar may be slidably coupled to the plug surface between the retaining member and the shoulder.

Optionally, the collar may have an inner surface and a plurality of barb members circumferentially distributed about the inner surface of the collar. The sleeve member may include barbed cut-outs that are configured to mate with the barb members when the collar and the sleeve member are in the locked position.

DETAILED DESCRIPTION OF THE INVENTION

Figure 1:
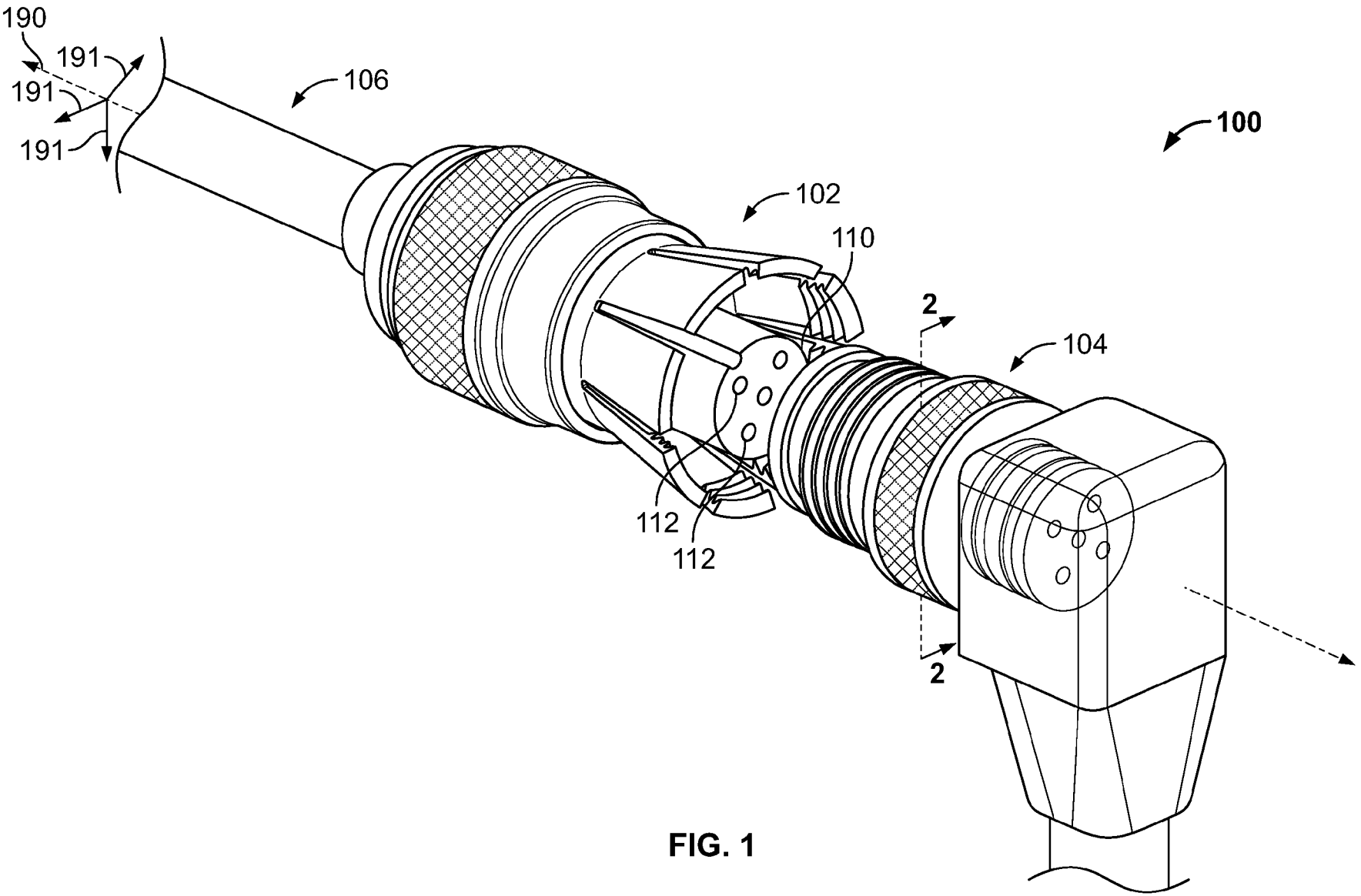
FIG. 1 is a perspective view of a connector system formed in accordance with one embodiment.

FIG. 1 is a perspective view of a connector system 100 formed in accordance with one embodiment. The connector system 100 is used to connect a cable assembly 106 to an electrical device or system (not shown) and includes an electrical connector 102 (also referred to as a first connector) and a second connector or header 104. In FIG. 1, the electrical connector 102 is disengaged from the header 104. To mate the connector 102 with the header 104, the connector 102 is moved along a central longitudinal axis 190 toward the header 104. As will be described in greater detail below, some of the embodiments described herein include connectors 102 that are configured to mate with a header having external threads or ridges. Despite the threads or ridges, the connector 102 may engage the header 104 by being pushed in the axial direction into the header 104 without substantial rotation, and the connector 102 may disengage from the header 104 by being pulled in the axial direction. Furthermore, when fully mated, the connector 102 may form an environmental seal around an electrical and/or fiber optic connection between the header 104 and cable assembly 106.

As shown in FIG. 1, the connector 102 includes a plug body 110 having a plurality of contact channels 112 that house mating contacts (not shown). The plug body 110 is inserted into the header 104 where mating contacts 202 (shown in FIG. 2) of the header 104 are inserted into the contact channels 112 to connect with the mating contacts of the body connector 102. However, the connector 102 and the header 104 may be configured to include a variety of contacts or pluggable connectors. For example, the connector 102 may have a registered jack plug or an LC connector that engages a corresponding receiver within the header. Furthermore, the plug body 110 may be a head for a coaxial cable.

Figure 2:
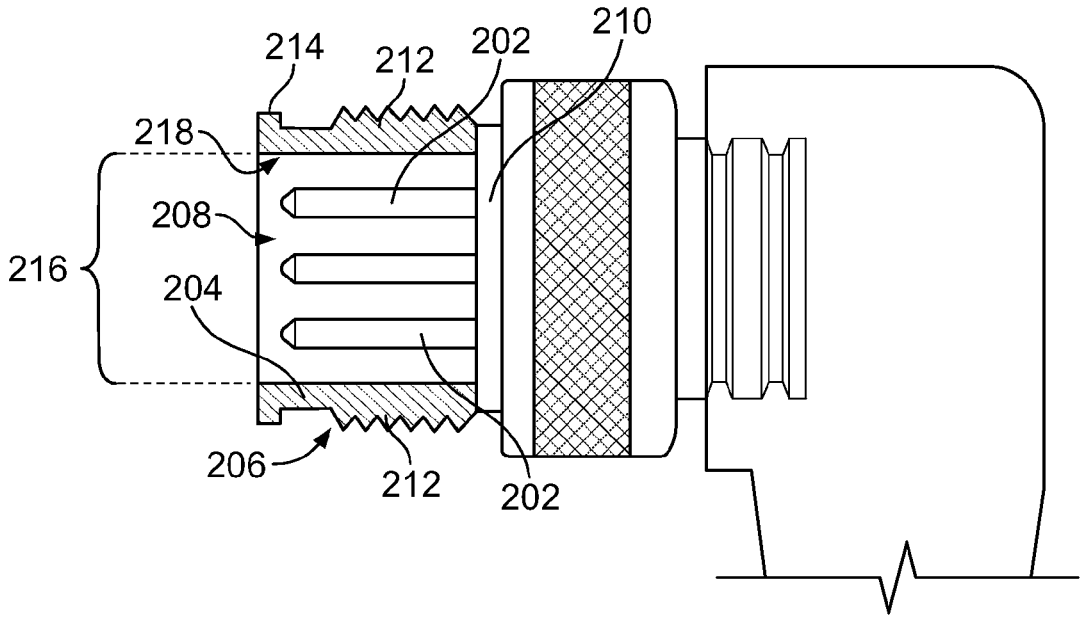
FIG. 2 is a cross-sectional view of a header taken along the line 2-2 shown in FIG. 1.

FIG. 2 illustrates a cross-sectional view of the header 104 taken along the line 2-2 in FIG. 1. The header 104 may include a stem wall 204 having an outer wall surface 206 and an inner surface 218. The stem wall 204 may include a front edge 214 that defines an opening 216 to a cavity 208 that extends in an axial direction therein. The stem wall 204 surrounds and protects the mating contacts 202 held within. Also, the header 104 may also have a contact base 210 at a rear end of the cavity 208. The contact base 210 may function as a positive stop when the plug body 110 (FIG. 1) is inserted into the cavity 208. Also shown, the wall surface 206 may include a plurality of ridges or threads 212 that extend radially outward from the wall surface 206. (The radial direction is indicated by axes 191 shown in FIG. 1.) The threads 212 may extend partially or completely around the wall surface 206 and may extend from proximate to the front edge 214 to proximate to the contact base 210. In alternative embodiments, the wall surface 206 may form a single ridge or bump configured to be engaged by the connector 102.

In the illustrated embodiment the connector 102 is a female connector and the header 104 is a male connector. However, those skilled in the art understand that female connectors may have male parts, e.g., the plug body 110, in addition to the female parts, e.g., the contact channels 112. Likewise, male connectors may have female parts, e.g., the cavity 208, in addition to the male parts, e.g., mating contacts 202. As such, alternative embodiments of the connector 102 may be male connectors that mate with the header 104, which could be a female connector. Thus, the description of the illustrated embodiment herein is not intended to be limiting.

Figure 3:
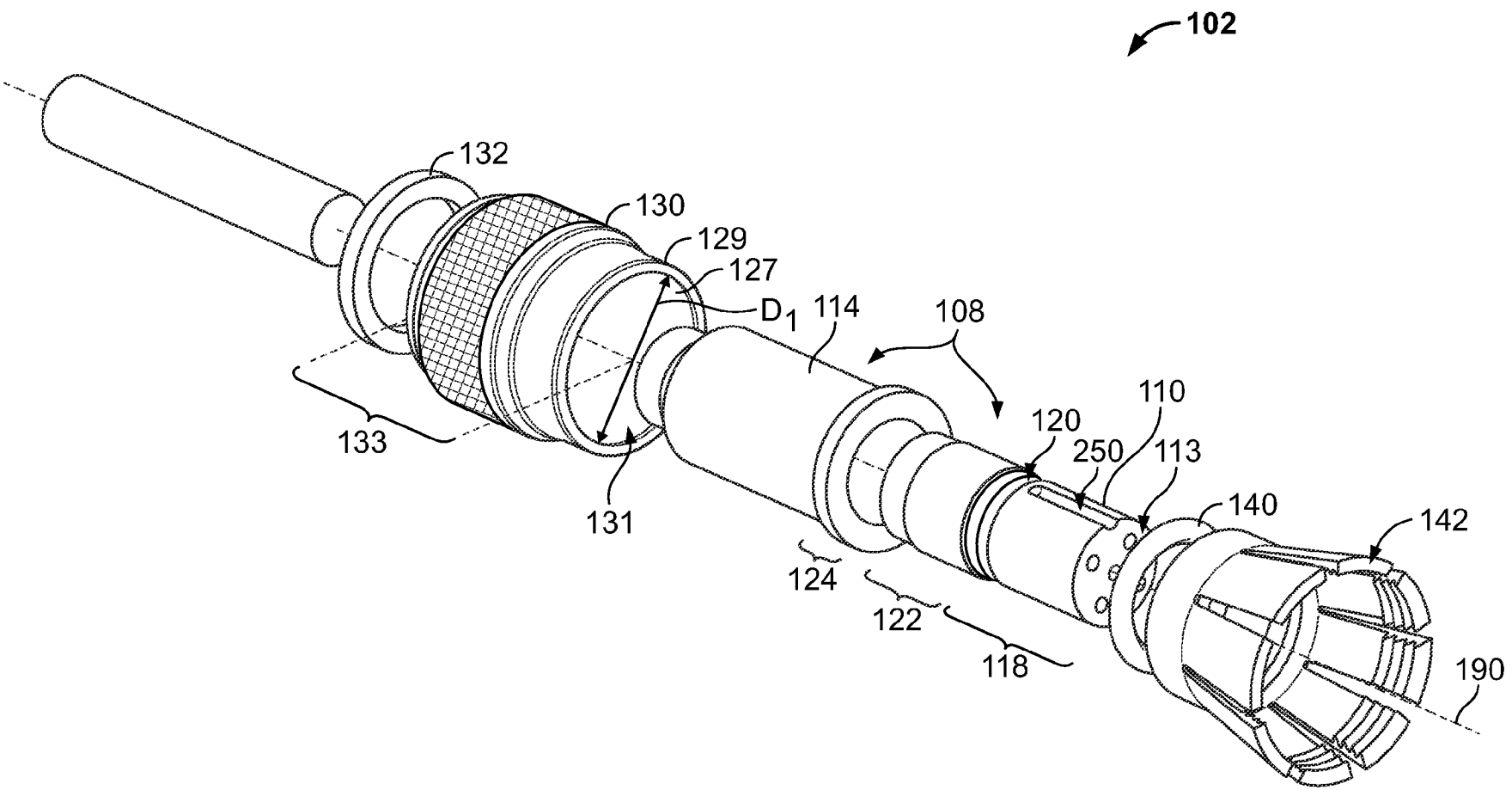
FIG. 3 is an exploded view of an electrical connector formed in accordance with one embodiment.

FIG. 3 is an exploded view of the connector 102 and illustrates components that may be used to assemble the connector 102. As shown, the components are distributed along the central axis 190. The connector 102 may include a plug assembly 108 configured to engage the header 104. In one embodiment, the plug assembly 108 is formed from the plug body 110 and an intermediate housing 114. However, in alternative embodiments, the plug assembly 108 may include features of the plug body 110 and the intermediate housing 114 described herein that are integrally formed into one part. The plug body 110 has an outer plug surface 116 and includes an front portion 118 that may be shaped and configured to mate with the inner surface 218 (FIG. 2) of the header 104 (FIG. 2). The front portion 118 may extend from a front end 113 to a sealing groove 120. The plug body 110 may also include a back portion 122 that is configured to couple or engage with the intermediate housing 114. Also shown, the intermediate housing 114 may include an outer housing surface 126 having a shoulder 124 that extends radially outward therefrom. When the intermediate housing 114 and the plug body 110 are engaged, the housing surface 126 and the plug surface 116 may form a unitary outer surface of the plug assembly 108. When the plug body 110 is inserted into the intermediate housing 114, the shoulder 124 may be positioned proximate to the sealing groove 120.

The connector 102 may also include a movable collar 130 having a passage opening 131 leading to a collar passage 133 extending therethrough. The collar passage 133 defined by an inner surface 127 of the collar 130. As shown, the passage opening 131 is substantially circular and includes a diameter $D_1$. The collar 130 may also include a grip portion 134 (shown in FIG. 5) that extends radially inward into the collar passage 133. The collar 130 is configured to surround at least of a portion of the plug assembly 108 and the header 104 when the connector system 100 (FIG. 1) is fully mated. More specifically, the grip portion 134 may be slidably coupled to the housing surface 126. As will be discussed in greater detail below, the collar 130 may move along the housing surface 126 in the axial direction between a retracted position (shown in FIG. 5) and a locked position (shown in FIG. 6). Furthermore, the collar 130 may include knurling or ridges to facilitate gripping the collar 130 by a user. Also shown, the connector 102 may include a retaining member 132 that is configured to grip the housing surface 126 of the intermediate housing 114. As such, the grip portion 130 may slide along the housing surface 126 between the retaining member 132 and the shoulder 124.

Also shown, the connector 102 may also include a sealing band 140 and a sleeve member 142. The sealing band 140 may be made from a compressible material (e.g., an o-ring) and is configured to grip and be held within the groove 120 when the connector 102 is fully assembled. In one embodiment, the sealing band 140 is a single compressible o-ring. As will be discussed in more detail below, the sealing band 140 and/or the sleeve member 142 may cooperate with the collar 130 and the wall surface 206 of the header 104 to form a sealing mechanism for protecting the connection from the surrounding environment.

As shown in FIG. 3, the components used to assemble the connector 102 have a substantially annular or cylindrical shape. However, in alternative embodiments, the connector 102 and the header 104 may be configured to have a variety of shapes. For example, the header 104 may be square, octagonal, semi-circular, and the like. Likewise, the plug assembly 108 or plug body 110 may be shaped to complement the shape of the header 104.

Figure 4:
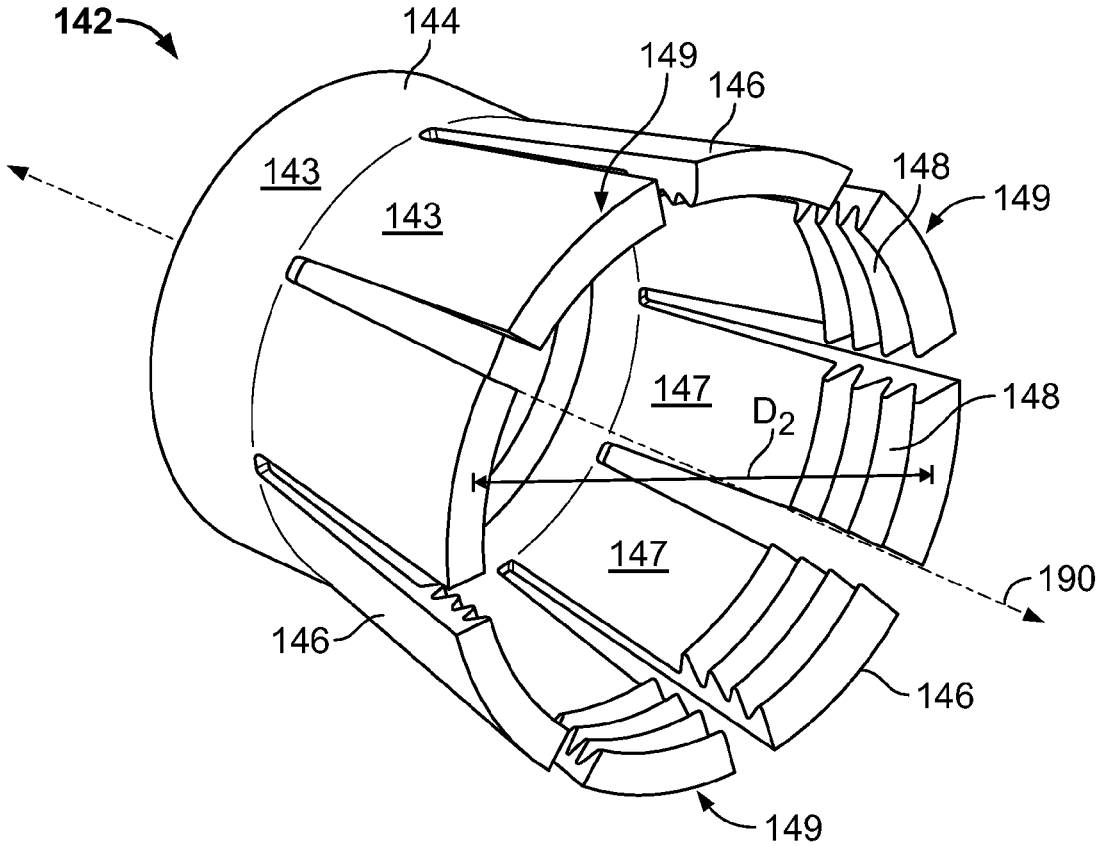
FIG. 4 is a sleeve member that may be used with the connector shown in FIG. 3.
Figure 5:
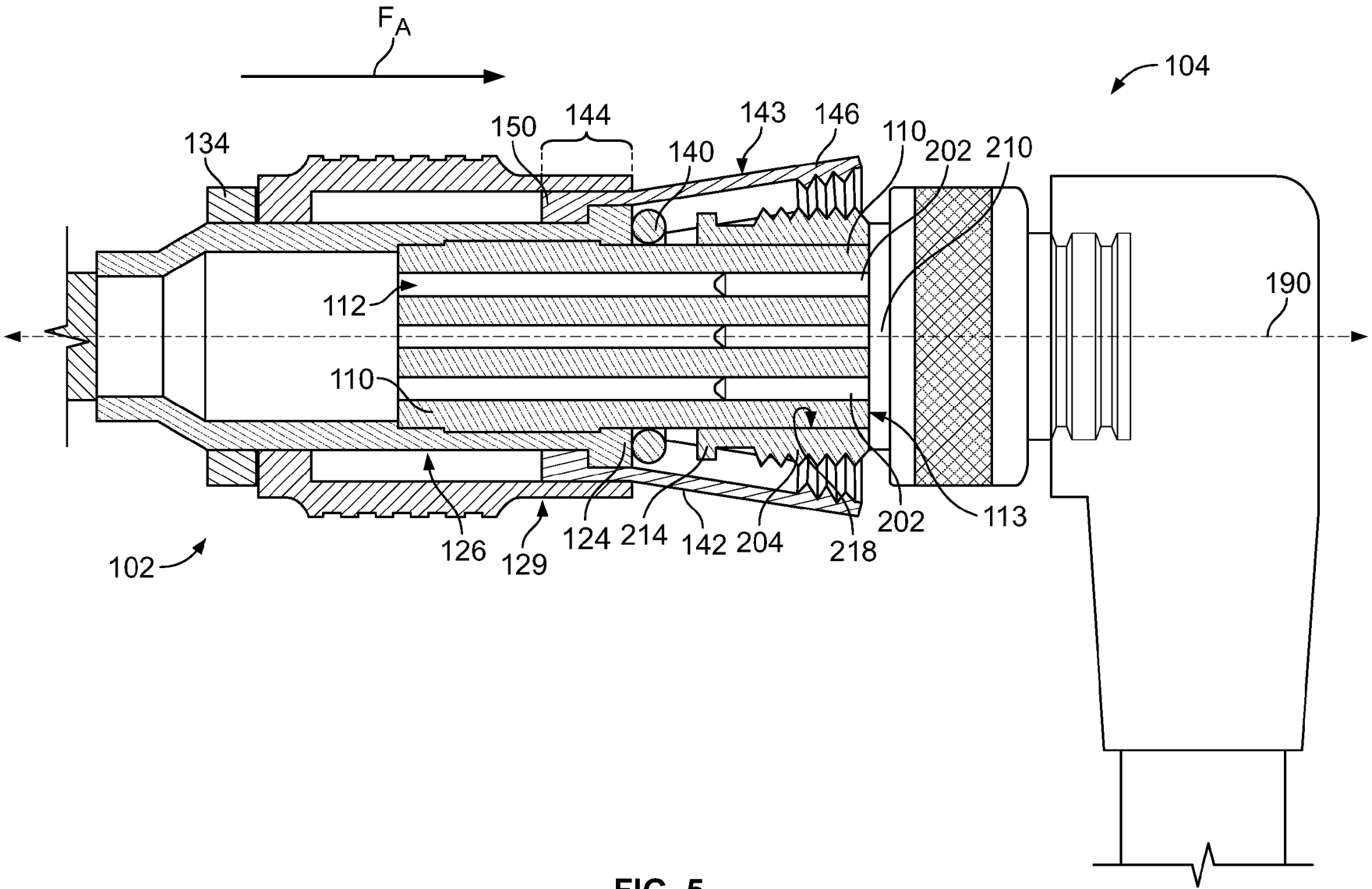
FIG. 5 is a cross-sectional view of the fully assembled connector shown in FIG. 3 in the retracted position.

FIG. 4 is an enlarged view of the sleeve member 142. The sleeve member 142 may include a base portion 144 that is configured to extend around and couple to the plug assembly 108 and, more specifically, the intermediate housing 114 (FIG. 3). The base portion 144 may have a substantially cylindrical shape that extends in the axial direction. The base portion 144 may include a shoulder or grip 150 that extends radially inward. As shown in FIG. 5, the grip 150 may engage the housing surface 126 (FIG. 3) and/or the shoulder 124 (FIG. 3). When the connector 102 (FIG. 1) is fully assembled, the base portion 144 may be held between the housing surface 126 and/or the shoulder 124 and the collar 130 (FIG. 3).

In the illustrated embodiment, the sleeve member 142 includes a plurality of fingers 146 that extend outward from the base portion 144 to a distal end 149. Each finger 146 may be defined between an inner surface 147 and an outer surface 143. The fingers 146 may be moved from a flared arrangement (as shown in FIG. 4) to a closed arrangement (shown in FIG. 6) when the connector 102 is fully mated with the header 104. In the flared arrangement, the inner surfaces 147 of the fingers 146 proximate to the distal ends 149 may form an opening in the shape of a circle that has a diameter $D_2$. In one embodiment $D_2$ is greater than $D_1$. The fingers 146 may be biased or configured to be in the flared arrangement and extend along and away from the central axis 190. As shown, in the flared arrangement the fingers 146 are in a relaxed state. In the closed arrangement, the fingers 146 are compressed and held against the wall surface 206 and form a substantially cylindrical body. As shown, the fingers 146 may be substantially identical arcuate portions of the cylindrical body that lie directly adjacent (i.e., touching or almost touching) to each other when the fingers 146 are in the compressed arrangement. The inner surface 147 may be shaped or configured to complement the wall surface 206. In the illustrated embodiment, the inner surface 147 may include one or more ridges or thread elements 148 that extend radially inward from the inner surface 147. The thread elements 148 may be positioned proximate to the distal end 149 of the corresponding finger 146 and be configured to engage the threads 212 extending from the wall surface 206.

Furthermore, the outer surface 143 may be substantially smooth as the outer surface 143 extends axially from the base portion 144 toward the distal ends 149 of the fingers 146. More specifically, the outer surface 143 may form a tangential line that extends parallel to the central axis 190. For example, the outer surface 143 may not include ridges or protrusions that interfere with or interface with the sleeve member 142 when the sleeve member 142 is moved axially forward. As such, when the collar 130 is in the locked position the outer surface 143 may be in substantial contact with the inner surface 127 of the collar 130. Also, the fingers 146 may have a substantially linear body such that a tangential line of the inner surface 147 (not including the thread elements 148) is parallel to a tangential line of the outer surface 143.

In alternative embodiments, the fingers 146 may not form a substantially cylindrical body but may be separated from each other a predetermined distance such that gaps exist between the adjacent fingers 146 when the fingers 146 are in the compressed arrangement. Furthermore, the fingers 146 may form other shapes such that the fingers 146 do not form a substantially cylindrical body when the fingers are in the compressed arrangement. For example, the fingers 146 may include a narrower trunk that extends from the base portion 144 and gradually widens such that the fingers 146 do not touch each other at the trunks but may touch each other at the distal ends 149 of the fingers 146. With less material extending from the base portion 144, the fingers 146 may be require less force to compress.

In the illustrated embodiment, the sleeve member 142 may be made from a flexible material, such as a metal alloy or resin. In one embodiment, the material is slightly compressible, such as a rubber, plastic, or similar dielectric material.

Figure 6:
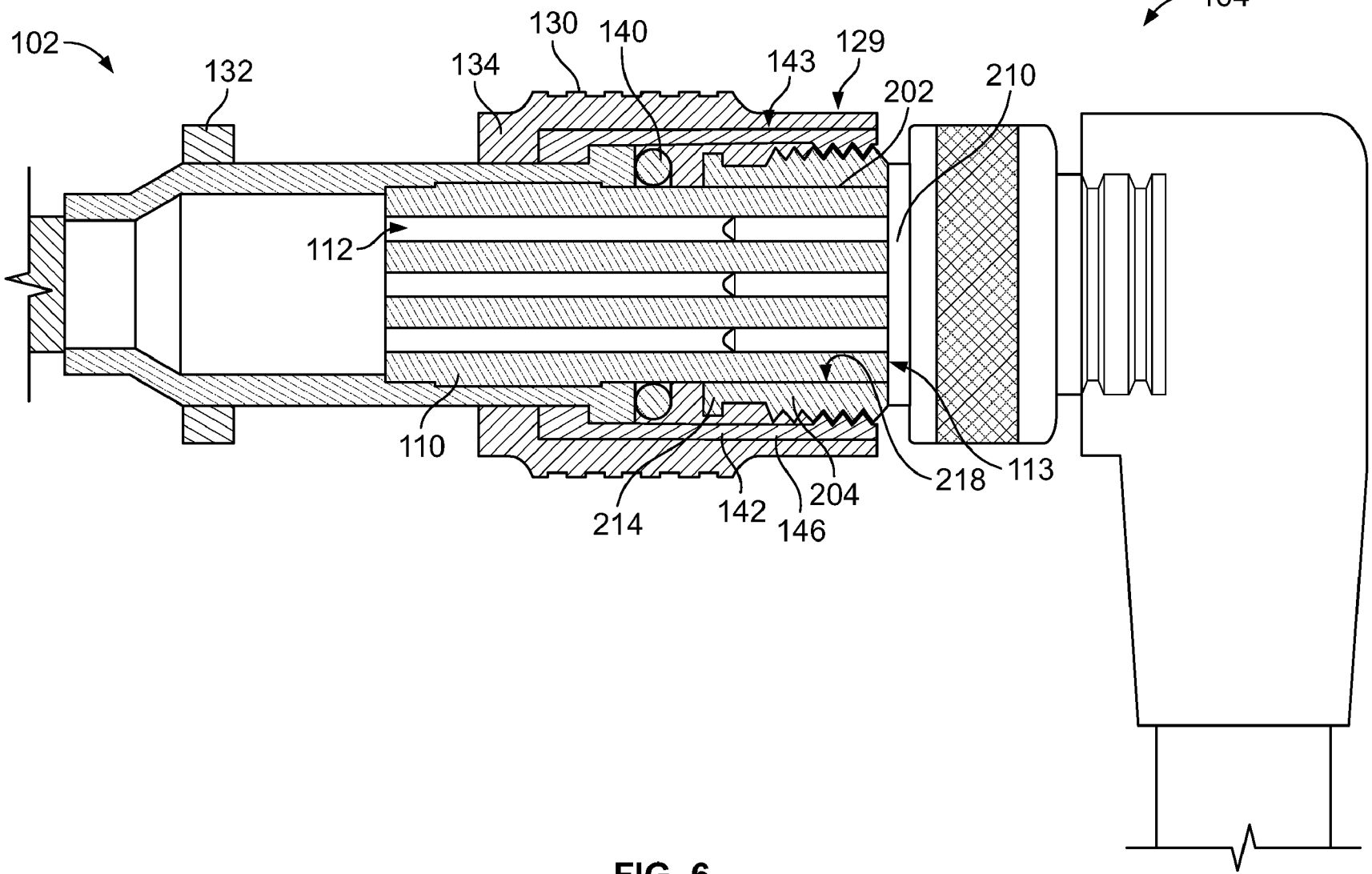
FIG. 6 is a cross-sectional view of the fully assembled connector shown in FIG. 3 in the locked position.

FIG. 5 is a cross-sectional view of the fully assembled connector 102 in the retracted position, and FIG. 6 is a cross-sectional view of the connector 102 in the locked position. Before mating the connector 102 and the header 104, the collar 130 is in a retracted position such that the grip portion 134 is positioned proximate to the retaining member 132 along the housing surface 126 of the intermediate housing 114. While in the retracted position, a rim portion 129 of the collar 130 surrounds the base portion 144 of the sleeve member 142 allowing the fingers 146 to be in the relaxed condition and in the flared arrangement. To mate the connector 102 and the header 104 together, an axial force $F_A$ is applied to the connector 102 to advance the connector 102 toward the header 104 along the central axis 190 (FIG. 5). The plug body 110 is inserted through the opening 216 (FIG. 2) and into the cavity 208 (FIG. 2). As discussed above, the plug surface 116 (FIG. 3) and the front portion 118 (FIG. 3) may be configured to mate with the inner surface 218 of the stem wall 204. For example, the front portion 118 may include a groove or key 250 (FIG. 3) that engages a corresponding protrusion (not shown) within the cavity 208 to facilitate orienting the plug body 110. As the plug body 110 advances through the cavity 208, the mating contacts 202 of the header 104 are inserted into the contact channels 112 of the plug body 110 and engage corresponding mating contacts (not shown) within the contact channels 112. Also, as the connector 102 engages the header 104, the front edge 214 slides along the plug surface 116 toward the sealing band 140. The sleeve member 142 and the fingers 146 are in the flared arrangement. The plug body 110 continues to advance through the cavity 208 until the front end 113 of the plug body 110 engages the contact base 210 and/or until the front edge 214 of the header 104 engages the sealing band 140.

When the plug body 110 engages the contact base 210 and/or the front edge 214 of the header 104 engages the sealing band 140, the plug body 110 stops advancing forward through the cavity 208. However, if the axial force $F_A$ continues to be applied, the collar 130 then begins to advance and slide over the outer surface 143 of the sleeve member 142. The axial movement of the collar 130 causes the rim portion 129 to slide over the base portion 144 to engage and compress the fingers 146 into the wall surface 206 of the header 104. In the illustrated embodiment, the outer surface 143 of the sleeve member 142 is substantially smooth allowing the collar 130 to slide freely over the outer surface 143 until the grip portion 134 engages the base portion 144 of the sleeve member 142. As such, the collar 130 is in the locked position. In the illustrated embodiment, the fingers 146 are fully compressed against the wall surface 206 such that the fingers 146 and the base portion 144 form a substantially cylindrical body. In the locked position, the fingers 146 and the wall surface 206 are electrically connected.

As shown in FIG. 6, when the collar 130 is in the locked position and the fingers 146 are in the closed arrangement, the sealing band 140 may be compressed by one or more of the plug surface 116, the fingers 146, the shoulder 124, and the front edge 214 of the header 104. In the illustrated embodiment, the sealing band 140 is covered by the fingers 146 and is compressed between the shoulder 124 and the front edge 214. In an alternative embodiment, the sealing band 140 may be compressed between each of the plug surface 116, the fingers 146, the shoulder 124, and the front edge 214. As such, the connector 102 and the header 104 engage to form an environmental seal to protect the electrical and/or optical connection from the surrounding environment.

To disengage the connector 102 with the header 104, a withdrawal force is applied to the collar 130 in the opposite direction of the axial force $F_A$ causing the collar 130 to slide backward toward the retaining member 132. As the collar 130 is retracted and slides onto the base portion 144, the fingers 146 may move from the closed arrangement to the flared arrangement (i.e., flex from a compressed condition to the relaxed condition). In an alternative embodiment, if the sealing band 140 is partially compressed by the fingers 146, the sealing band 140 exerts an outward force against the fingers 146. When the collar 130 is retracted, the sealing band 140 may facilitate forcing the fingers 146 outward into the flared arrangement.

Figure 7:
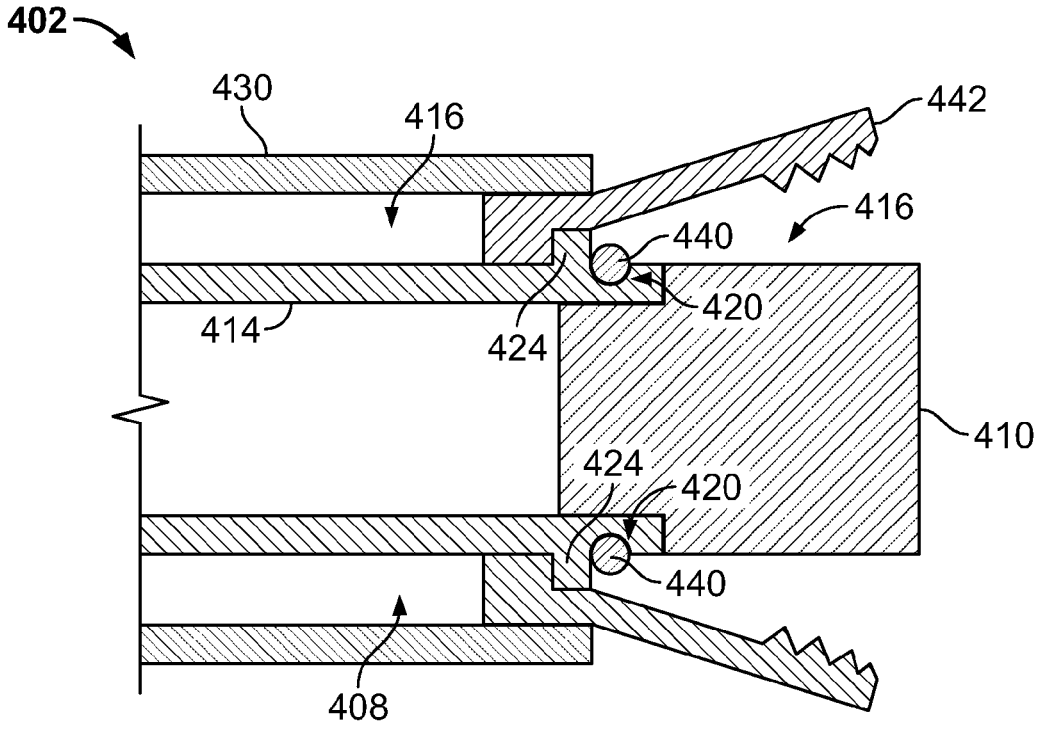
FIG. 7 is a cross-sectional view of a connector that may be formed in accordance with an alternative embodiment.
Figure 8:
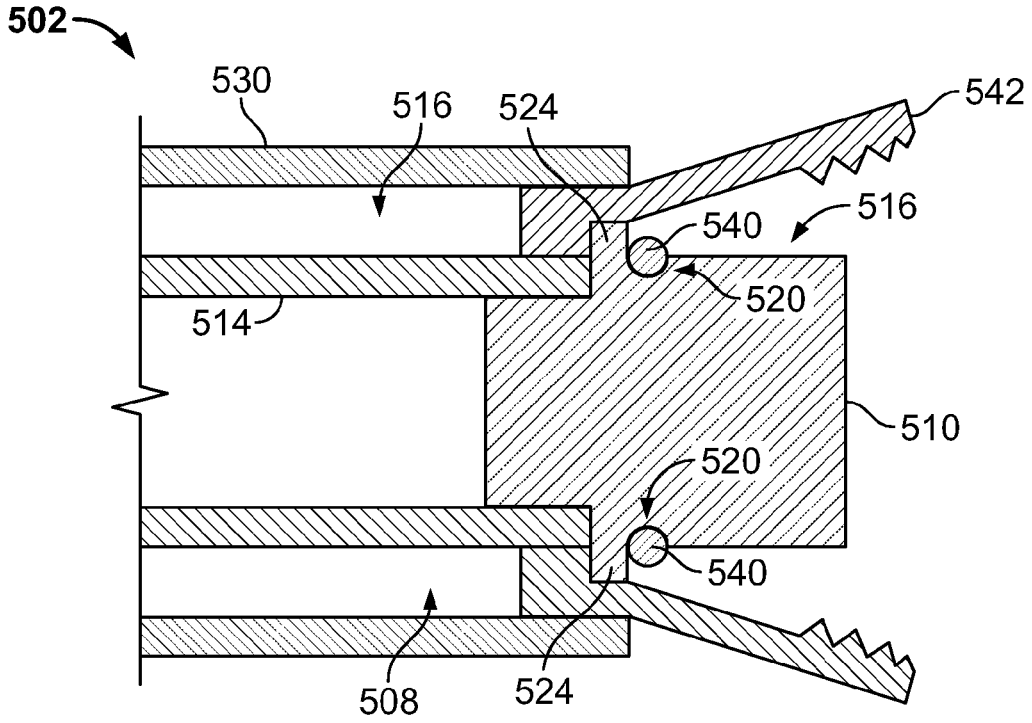
FIG. 8 is a cross-sectional view of a connector that may be formed in accordance with an alternative embodiment.

FIGS. 7 and 8 are cross-sectional views of electrical connectors 402 and 502 that may be formed in accordance with alternative embodiments. As shown in FIG. 7, the connector 402 includes similar components and features as described above with respect to connector 102 (FIG. 3). The connector 402 includes the plug body 410 engaged with an intermediate housing 414, a collar 430, and a sleeve member 442 held between the collar 430 and the intermediate housing 414. When the plug body 410 and the intermediate housing 414 are engaged, the plug body 410 and the intermediate housing 414 form a plug assembly 408 having a unitary outer surface 416. As shown, the intermediate housing 414 includes a sealing groove 420 positioned proximate to a shoulder 424 that is configured to hold a sealing band 440.

As shown in FIG. 8, the connector 502 includes similar components and features as described above with respect to connector 102 (FIG. 3). The connector 502 includes the plug body 510 engaged with an intermediate housing 514, a collar 530, and a sleeve member 542 held by the collar 530, the plug body 510, and the intermediate housing 514. When the plug body 510 and the intermediate housing 514 are engaged, the plug body 510 and the intermediate housing 514 form a plug assembly 508 having a unitary outer surface 516. As shown the plug body 510 includes a shoulder 524 extending radially outward therefrom and a sealing groove 520 positioned proximate to the shoulder 524. The sealing groove 520 is configured to hold a sealing band 540.

Figure 9:
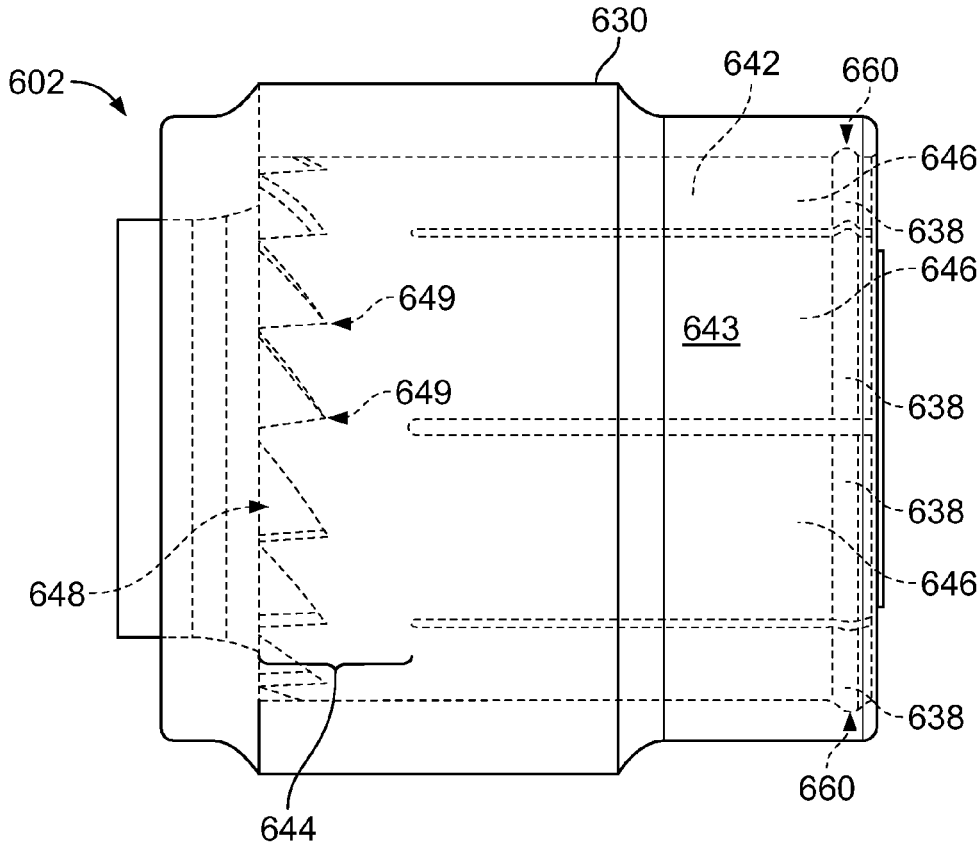
FIG. 9 is a side view of an electrical connector formed in accordance with one embodiment.

FIG. 9 is a side view of an electrical connector 602 formed in accordance with an alternative embodiment. The connector 602 may have similar parts and features as described with reference to the connectors 102, 402, and 502 (FIGS. 1, 7, and 8, respectively) and may be configured to engage a header (not shown), such as the header 104 illustrated in FIG. 2. The connector 602 includes a sleeve member 642 and a movable collar 630 that is configured to slide over the sleeve member 642 when moved between a retracted position and a locked position (shown in FIG. 9). The sleeve member 642 may include a base portion 644 and a plurality of fingers 646 that extend away from the base portion 644 and are biased to flex away in a flared arrangement when the connector 602 is in a retracted position. Similar to the fingers 146 (FIG. 4), the fingers 646 may have inner thread elements (not shown) that are configured to engage external threads (not shown) of the header. The sleeve member 642 also has an outer surface 643. As shown in FIG. 9, each finger 646 includes an outer ridge 638 that protrudes or projects from the outer surface 643. In addition, the outer surface 643 of the base portion 644 may be machined or formed to include a plurality of barbed cut-outs 648 that are circumferentially distributed around the sleeve member 642. Each barbed cut-out 648 may have sidewalls that intersect to form a corner 649.

Figure 10:
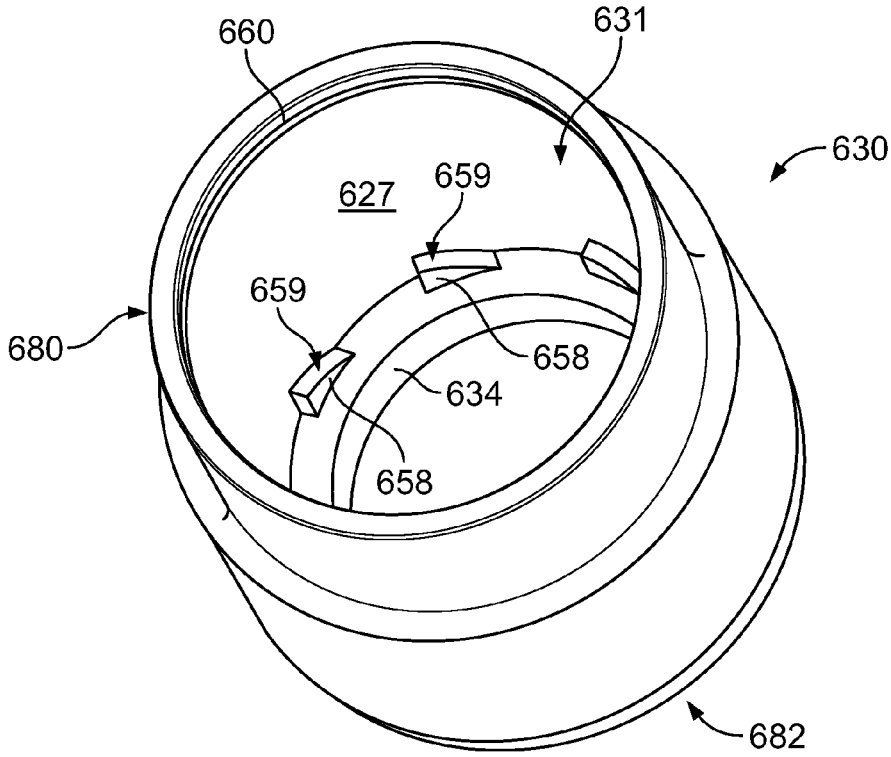
FIG. 10 is a perspective view of a movable collar that may be used with the electrical connector shown in FIG. 9.

FIG. 10 is a perspective view of the collar 630. As shown, the collar 630 has a front end 680, a rear end 682, and an internal passage extending therebetween. The collar 630 includes an opening 631 leading into the internal passage and has an inner surface 627 that defines the internal passage. In the illustrated embodiment, the collar 630 may form a grip portion 634 that projects radially inward from the inner surface 627 at the rear end 682 of the collar 630. The grip portion 634 may include a plurality of barb members 658 that may be evenly distributed around the inner surface 627 and extend from or proximate to the grip portion 634. The barb members 658 form points 659 and are configured to engage and mate with the barbed cut-outs 648 when in the locked position. In the illustrated embodiment, the number of barb members 659 may be fewer than the number of barbed cut-outs 648.

Also shown in FIG. 10, the inner surface 627 may form an engagement groove(s) 660 proximate to the front end 680 of the collar 630. The engagement groove 660 may be configured to mate with and grip the outer ridge 638 of the sleeve member 642 when the connector 602 is in the locked position. Although the engagement groove 660 extends completely around the circumference of the inner surface 627 in FIG. 10, alternative embodiments may include partial grooves that extend partially along the circumference of the inner surface 627. Each partial groove may be configured to engage a corresponding outer ridge 638.

To move the connector 602 from a retracted position (not shown) to a locked position, the collar 630 is moved axially toward the header and slides over the outer surface 643 of the sleeve member 642. If the barb members 658 are not aligned with the barbed cut-outs 648 such that the points 659 of the barb members 658 are directly inserted into the corners 649 of the cut-outs 648, the points 659 may engage one of the sidewalls of the cut-outs 648. If the axially force is continuously applied, the collar 630 may rotate slightly and the sidewall may direct the point 659 into the corner 649. Furthermore, as the front end 680 of the collar 630 slides over the outer surface 643 of the sleeve member 642, the front end 680 may engage the outer ridge 638 thereby slightly deflecting or forcing the corresponding finger 646 radially inward. When the finger 646 is deflected, the front end 680 of the collar 630 may slide over the outer ridge 638. The fingers 646 flex back into the undeflected position when the groove 660 clears the outer ridges 638 of the fingers 646. When in the locked position, the outer ridges 638 of the sleeve member 642 and the groove 660 of the collar 630 interact to maintain the connector 602 in the locked position. To disengage the collar 630 from the sleeve member 642, the collar 630 may be pulled axially away from the header or may be rotated in the counter clockwise direction. The sidewalls of the barbed cut-outs 648 force the collar 630 to be moved axially backward. Again, the fingers 646 are deflected inward allowing the collar 630 to slide over the outer ridges 638 and away from the header. As such, the bar members 659 and the barbed cut-outs 648, along with the outer ridges 638 and the groove 660, may interact with each other to provide a tactile indication to the user that the connector 102 is in the locked position. However, embodiments described herein are not required to use both features, but may use neither feature, one, or both.

Embodiments of the connector 102 described herein may be push-pull type connectors and may include one or more sealing mechanisms for forming an environmental seal around the connection. More specifically, with respect to FIG. 6, the connector 102 may form a seal between the plug surface 116, the shoulder 124, and the front edge 214. In addition, the connector 102 may form a seal between external threads 212 of the wall surface 206 and the inner thread elements 148 of the fingers 146. When the thread elements 148 initially engage the threads 212, the thread elements 148 may not be properly oriented or positioned to sealably mate or engage with the threads 212. However, because the sealing band 140 may be made from a compressible material and/or the sleeve member 142 may be made from a flexible or compressible material, as the collar 130 moves over the outer surface 143 of the fingers 146, the sealing band 140 and/or the sleeve member 142 may allow or cause slight movement such that the threads 212 and the thread elements 148 form a tight mating. Although the sealing band 140 may be compressed to allow or tolerate slight movement, the connector 102 may engage the header 104 without substantial rotation (e.g., without rotating the connector 102 more than 10 degrees).

It is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector configured to sealably engage a header, the header including a cavity therein and an outer wall surface having external threads, the connector comprising:

a plug assembly including an outer plug surface configured to be inserted into the cavity of the header;

a sleeve member coupled to and surrounding the plug surface, the sleeve member including a plurality of fingers biased to flex away from the plug surface in a flared arrangement, the fingers including inner thread elements configured to engage a portion of the external threads;

a sealing band gripping the plug surface; and a collar configured to slide over the sleeve member when moved between a retracted position and a locked position, wherein the collar compresses the fingers against the wall surface of the header when the collar moves from the retracted position to the locked position such that the fingers engage the sealing band, the sealing band being compressed between the plug assembly and the header.

2. The connector in accordance with claim 1 wherein the plug assembly comprises an intermediate housing forming a channel therethrough and a plug body at least partially inserted into the housing channel.

3. The connector in accordance with claim 1 wherein the collar is slidably coupled to the plug surface.

4. The connector in accordance with claim 1 wherein when the collar is in the locked position, the fingers of the sleeve member are in a closed position forming a cylindrical body substantially surrounding a portion of the wall surface.

5. The connector in accordance with claim 1 wherein:

the plurality of fingers have an outer surface and a distal end, each finger including an outer ridge projecting from the outer surface proximate to the distal end; and the collar includes an inner surface having an engagement groove extending circumferentially therearound, wherein the outer ridges are configured to mate with the engagement groove when the collar is moved into the locked position.

6. The connector in accordance with claim 1 wherein the sleeve member further comprises a base portion having the fingers extending therefrom, the base portion being substantially cylindrical and extending in an axial direction.

7. The connector in accordance with claim 1, the header including a front edge defining an opening to the cavity therein, wherein the sealing band is compressed between the front edge and the plug assembly when the collar is in the closed position.

8. The connector in accordance with claim 1 wherein the plug assembly further comprises a shoulder extending radially outward from the plug surface, wherein when the collar is in the locked position the sealing band is compressed by the shoulder and header.

9. The connector in accordance with claim 8 wherein the plug assembly includes a sealing groove extending around the plug surface proximate to the shoulder, the sealing band gripping the plug assembly within the sealing groove.

10. The connector in accordance with claim 8 wherein when the collar is in the locked position the sealing band is compressed between the shoulder, the header, and the fingers.

11. An electrical connector configured to sealably engage a header, the header including a cavity therein and an outer wall surface having external threads, the connector comprising:

a plug assembly including an outer plug surface configured to be inserted into the cavity of the header;

a sleeve member coupled to and surrounding the plug surface, the sleeve member including a plurality of fingers biased to flex away from the plug assembly in a flared arrangement, the fingers having an outer surface and including inner thread elements configured to engage a portion of the external threads; and a collar configured to slide over the sleeve member when moved between a retracted position and a locked position, wherein, when the collar moves from the retracted position to the locked position, the collar engages the outer surface of the fingers and compresses the fingers against the wall surface of the header such that the inner thread elements of the fingers sealably engage the external threads, wherein the sleeve member is electrically connected to the header when the fingers are engaged with the external threads.

12. The connector in accordance with claim 11 wherein the outer surfaces of the fingers are in substantial contact with the inner surface of the collar.

13. The connector in accordance with claim 11 wherein sleeve member includes a base portion surrounding and coupled to the plug surface, the fingers extending from the base portion.

14. The connector in accordance with claim 11 wherein, when the collar is in the locked position, the fingers of the sleeve member are in a compressed arrangement forming a cylindrical body substantially surrounding the wall surface.

15. The connector in accordance with claim 11 wherein when the fingers of the sleeve member are in a flared arrangement, the fingers are capable of moving over the external threads on the wall surface.

16. The connector in accordance with claim 11 wherein the sleeve member further comprises a base portion having the fingers extending therefrom, the base portion being substantially cylindrical and extending in an axial direction.

17. The connector in accordance with claim 11 wherein the fingers include distal ends, the distal ends forming a circular opening having a diameter greater than a diameter of the collar when the fingers are in the flared arrangement.

18. The connector in accordance with claim 11 wherein the plug assembly comprises an intermediate housing forming a channel therethrough and a plug body at least partially inserted into the housing channel.

19. The connector in accordance with claim 18 wherein the intermediate housing includes a retaining member and a shoulder extending radially outward from the plug surface, the collar slidably coupled to the plug surface between the retaining member and the shoulder.

20. An electrical connector configured to sealably engage a header, the header including a cavity therein and an outer wall surface having external threads, the connector comprising:

a plug assembly including an outer plug surface configured to be inserted into the cavity of the header;

a sleeve member coupled to and surrounding the plug surface, the sleeve member including a plurality of fingers biased to flex away from the plug assembly in a flared arrangement, each of the fingers having an outer surface and including inner thread elements configured to engage a portion of the external threads; and a collar configured to slide over the sleeve member when moved between a retracted position and a locked position, wherein, when the collar moves from the retracted position to the locked position, the collar engages the outer surface of the fingers and compresses the fingers against the wall surface of the header, such that the inner thread elements of the fingers sealably engage the external threads, and wherein the collar includes an inner surface having a plurality of barb members distributed circumferentially about the inner surface and the sleeve member includes a plurality of barbed cut-outs, each cut-out being configured to mate with a corresponding member when the collar and the sleeve member are in the locked position.

* * * * *